US005411415A

United States Patent [19]

Embo et al.

[11] Patent Number: 5,411,415

[45] Date of Patent: May 2, 1995

[54] SHIELDED PLUG CONNECTOR

[75] Inventors: Georges Embo, Langemark, Belgium; Horst Schiefele, München, Germany; Anton Schröcker, Munich, Germany; Hans Voss, Sauerlach, Germany; Albert Wiedemann, München, Germany; Reinhold Reich, Schäftlarn, Germany

[73] Assignee: Siemens Aktiengesellschaft, Munich, Germany

[21] Appl. No.: 230,635

[22] Filed: Apr. 21, 1994

[30] Foreign Application Priority Data

Oct. 21, 1991 [DE] Germany ..... 91 13 082 U

[51] Int. Cl.[6] ..... H01R 13/658

[52] U.S. Cl. ..... 439/610; 439/98

[58] Field of Search ..... 439/98, 99, 610

[56] References Cited

U.S. PATENT DOCUMENTS 4,272,148 6/1981 Knack, Jr. ..... 439/610

FOREIGN PATENT DOCUMENTS 90539 10/1983 European Pat. Off. ..... 439/610
0111162 6/1984 European Pat. Off. .
0112648 7/1984 European Pat. Off. .
0093992 8/1986 European Pat. Off. .
0255358 2/1988 European Pat. Off. .
3439931 5/1986 Germany .
8707004.9 7/1987 Germany .
8713046.7 3/1989 Germany .

*Primary Examiner*—Gary F. Paumen
*Attorney, Agent, or Firm*—Herbert L. Lerner; Laurence A. Greenberg

[57] ABSTRACT

A shielded plug connector includes at least one shielded cable having a cable shielding, a plug or socket insert having a metal collar, and a one-piece, one-shell, metal shielding housing. The shielding housing has a plug side at which the plug or socket insert is disposed. The plug side has an end surface and bearing points for the metal collar being recessed inwardly relative to the plug-side end surface, for end-surface contacting of the shielding housing with an appliance wall only at the plug-side end surface. The shielding housing has a connection side with a connection region for connecting the at least one shielded cable. The connection region has a connection-side end and a transverse wall. The transverse wall is recessed inwardly relative to the connection-side end, it has at least one lead-through formed therein and it is in direct end contact with the cable shielding.

16 Claims, 5 Drawing Sheets

SHIELDED PLUG CONNECTOR

CROSS-REFERENCE TO RELATED APPLICATION

This application is a Continuation of International Application Ser. No. PCT/EP92/02037, filed Sep. 3, 1992.

BACKGROUND OF THE INVENTION

Field of the Invention

The invention relates to a shielded plug connector having a metal shielding housing with a connection side to which at least one shielded cable is connected and a plug side at which a plug or socket insert having a metal collar is provided such a plug connector is known from German Petty Patent DE-GM 87 13 046.

The plug connector, which acts as a connecting member between self-contained electronic systems and peripherals or the outside, is asked to meet increasingly higher demands for electromagnetic compatibility. The development of electronic systems is characterized by an ever-increasing processing speed, or in other words high clock frequencies, in digital computation and control systems. That sharply increases the sensitivity to high-frequency factors. Those interference factors can lead to malfunctions that have a direct effect on the quality of the systems. On the other hand, interference factors also originate in electronic systems or appliances themselves that operate with steep-edged high-frequency signals in both the control and the power portions. In order to reduce or even completely cancel out the mutual influence of electronic systems on one another, the plug connector, as an interface element between a self-contained electronic system and its surroundings, is of decisive significance. The plug connector known from German Petty Patent DE-GM 87 13 046 is intended for those purposes. It has a two-part housing, and shielding plates or shrouds line the inside of the individual housing parts to provide electrical shielding. When the housing is put together, the shrouds are electrically connected, not directly, but rather by contact being made with the metal plug inserted into the housing and with a shield of a cable guided into the housing. In that plug connector, the metal plug body with its collar is disposed on the outside of the plug connector, on the plug-side end of the lower housing part. The connecting cable is connected mechanically by means of a collar clamp to the lower housing part, and electrically to a shroud disposed in the lower housing part.

In other commercially available plug connectors, the housing is put together from two half-shells, between which slight gaps may be present that considerably influence the shielding action. In the case of such housings, various shielding materials are used, such as solid-cast half-shells of aluminum, metal plates placed in plastic half-shells, or metallized plastic half-shells. Those half-shells are each electrically connected to the shielding braid of the cable and to the metal collar of the built-in plug. The metal collar of the built-in plug is usually fixed, and protrudes from the end surface of the housing. Accordingly, in typical plug pairs having one counterpart plug in the back or front wall assembly and one plug in the housing of the plug connector, there are gaps, specifically gaps between the counterpart plug and the wall and between the plug and the housing. In such plug connectors, there are accordingly a great number of junction points, and the flow course of the interference signals, which are to be diverted to ground, is finally as follows: cable shielding braid—housing wall—metal collar of the plug—metal collar of the counterpart plug appliance wall (ground). Surface currents can be carried into the interior of appliances, and/or interference factors can originate in the appliance itself.

Summary of the Invention

It is accordingly an object of the invention to provide a shielded plug connector, which overcomes the hereinafore-mentioned disadvantages of the heretofore-known devices of this general type and which meets elevated shielding requirements, of more than 80 dB, for instance.

With the foregoing and other objects in view there is provided, in accordance with the invention, a shielded plug connector, comprising at least one shielded cable having a cable shielding; a plug or socket insert having a metal collar; and a one-piece, one-shell, metal shielding housing, the shielding housing having a plug side at which the plug or socket insert is disposed, the plug side having an end surface and bearing points for the metal collar being recessed inwardly relative to the plug-side end surface, for end-surface contacting of the shielding housing with an appliance wall only at the plug-side end surface, and the shielding housing having a connection side with a connection region for connecting the at least one shielded cable, the connection region having a connection-side end and a transverse wall, the transverse wall being recessed inwardly relative to the connection-side end, having at least one lead-through formed therein and being in direct end contact with the cable shielding.

In such a plug connector, the number of junction points is reduced to a minimum.

In accordance with another feature of the invention, the metal housing includes a pressure cast part, particularly of aluminum. Contact is made between the cable shield and the housing of the plug connector by a direct end contact. In other Words, the cable shield is not, as in screwed-on collar clamps, in direct contact with the shielding housing only partially or through intermediate junctions but rather annularly and without any intermediate junctions. Moreover, end-surface contacting of the housing of the plug connector to an appliance wall is provided, so that an unhindered flow of surface currents is assured. Through the use of these provisions, a plug connector with only a few, gap-free electrical and mechanical junctions is created, so that the plug connector meets more-stringent shielding requirements. Moreover, a plug connector of this kind can be made economically in an embodiment that is easy to install and is simple in structure.

In accordance with a further feature of the invention, the bearing point for the metal collar of the plug or socket insert is recessed far enough inward that the plug or socket insert is located largely inside the shielding housing. As a result, the plug or socket insert is disposed inside the shielding housing, in an extensively mechanically and electrically protected manner.

In accordance with again another feature of the invention, there are provided securing elements for securing the shielding housing to the appliance wall, the shielding housing having an inner surface, and the plug or socket insert and the inner surface of the shielding housing defining one intermediate space therebetween each for leading through the securing elements.

In accordance with an added feature of the invention, with a view to the shielding action, the internal width of the shielding housing on the plug end is selected in such a way that when a plug connector is secured to an appliance wall, the plug or socket insert, its counterpart plug on the appliance wall and a lead-through opening in the appliance wall are laterally surrounded by the plug-side edge of the housing. Thus both the plug or socket insert, the counterpart plug and the recess in the appliance wall, are encapsulated in an electrically shielded fashion.

In accordance with again a further feature of the invention, the shielding housing has inner wall surfaces with two opposed steps disposed thereon forming the bearing points on the shielding housing for the metal collar of the plug or socket insert.

In accordance with again an added feature of the invention, the shielding housing has a wall, and there are provided diametrically opposed screws being screwed into the wall of the shielding housing radially between the bearing points and the plug-side end of the shielding housing, for floating support of the plug or socket insert in the shielding housing.

In accordance with an additional feature of the invention, there is provided a contact plate between the plug-side end of the shielding housing and the appliance wall. This kind of contact plate may, for instance, include a feathered spring plate. This is done in order to compensate for not completely flat end-surface bearing situations of a housing edge on an appliance wall, as may possibly occur, and to create a maximum number of contacting points in this region.

In accordance with yet another feature of the invention, the connection of the cable is accomplished by means of a union nut that can be screwed into the connection region of the shielding housing.

In accordance with yet a further feature of the invention, an end-surface contacting of the cable shielding on the transverse wall of the shielding housing is produced in a simple way by thrusting a sleeve over the exposed cable shielding, and folding over the cable shielding through 180° onto the sleeve on one end, with the union nut engaging the sleeve on the other end.

In accordance with again an added feature of the invention, there is provided a cable sheath on the cable shielding, the union nut having a neck resting on the cable sheath.

In accordance with again an additional feature of the invention, the neck has a window-like opening formed therein, and there is provided a cable binder being inserted into the window-like opening for tensile strain relief of the cable.

In accordance with still another feature of the invention, there is provided an additional tube of a shielding braid being thrust over the neck of the union nut and being firmly joined to the neck, and a clamping ring contacting the additional tube.

In accordance with still a further feature of the invention, the appliance wall has a counterpart plug disposed thereon, and the plug or socket insert and the counterpart plug have an encoding element.

In accordance with a concomitant feature of the invention, there are provided two screws which are displaceable in the plugging direction but are disposed in captive fashion on the shielding housing, as securing elements for securing the shielding housing to an appliance wall. In this case the plug connector, upon being connected to the counterpart plug, can first be inserted freely and without simultaneous influence from the securing process, and then, after the plug connection is made, it can be locked by means of the securing elements.

Other features which are considered as characteristic for the invention are set forth in the appended claims.

Although the invention is illustrated and described herein as embodied in a shielded plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
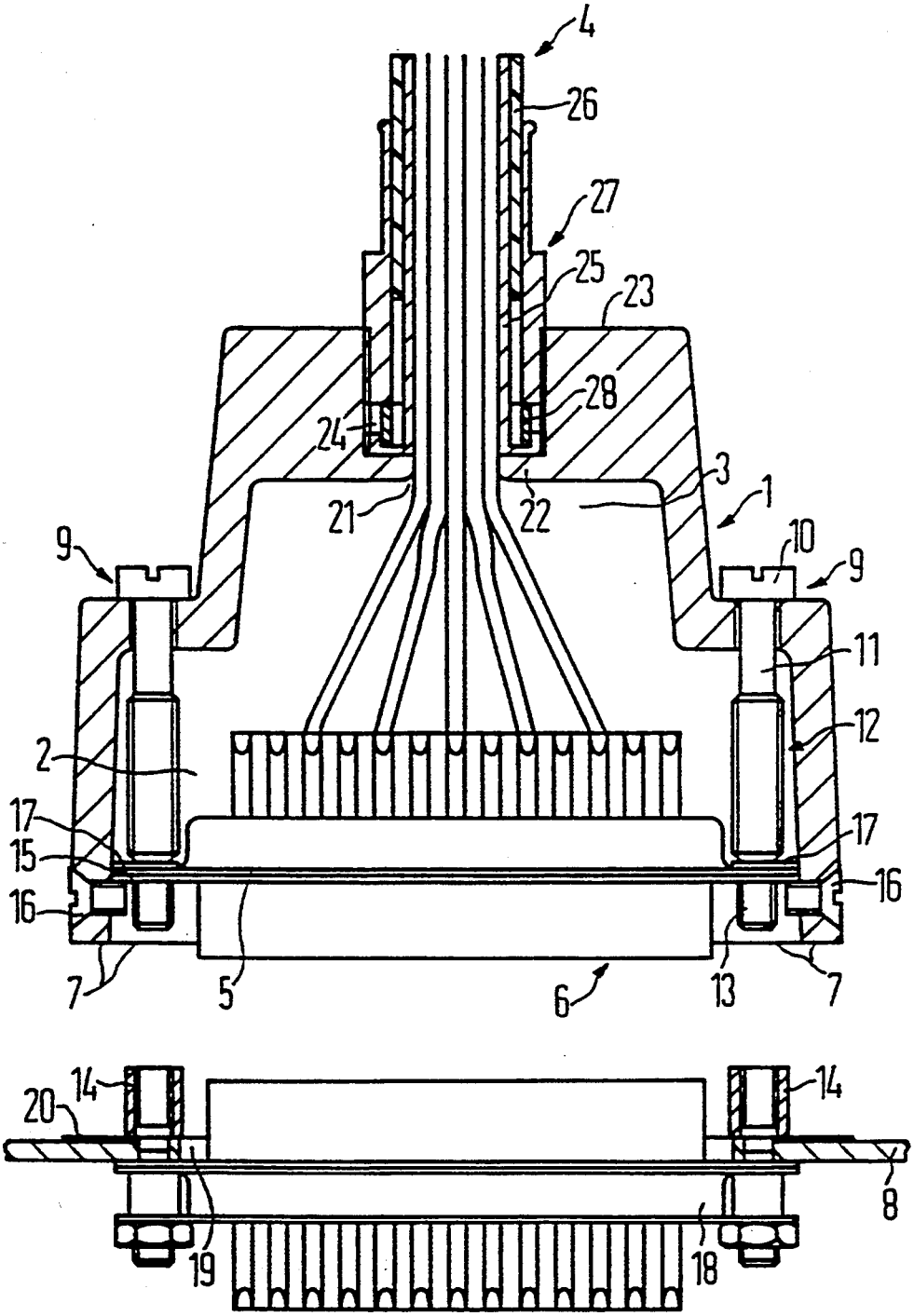
FIG. 1 is a fragmentary, diagrammatic, sectional view of a plug connector with a shielding housing and a cable lead-in, and a counterpart plug provided on an appliance wall, before a plug connection is made.

Referring now to the figures of the drawing in detail and first, particularly, to FIG. 1 thereof, there is seen a plug connector which has a metal shielding housing 1 being formed of a one-piece, one-shelled pressure cast part, particularly of aluminum. The shielding housing 1 is funnel-like in shape, with a further plug-side region 2 and a relatively narrower connection region 3 formed by a shoulder or step. At least one shielded cable 4 is connected in this connection region in a manner to be described in detail below. A plug or socket insert 6 which is provided in the plug-side region 2 has a metal collar 5 and is connected to the cable 4.

Bearing points 17 on the shielding housing 1 for the metal collar 5 of the plug or socket insert 6 is recessed far enough inward relative to a plug-side end 7 of the shielding housing 1 that the plug or socket insert 6 is located largely inside the shielding housing. End-surface contacting of the shielding housing on an appliance wall 8 can then be done exclusively through the plug-side end 7 of the shielding housing. The bearing points 17 on the shielding housing for the metal collar 5 of the plug or socket insert 6 are suitably constructed by two opposed steps on inner walls of the shielding housing.

Two screws 9 are provided as securing elements for a detachable securing of the shielding housing 1 to the appliance wall 8. The two screws 9 are displaceable in the plug-in direction, but are disposed in captive fashion on the shielding housing. The screws 9 are constructed with four different zones in the longitudinal direction.

These zones are a screw head 10 which may be slit for tightening purposes; a cylindrical neck zone 11; a male thread 12 having a diameter which is greater than the neck zone; and a small male thread 13 for being screwed into threaded sleeves 14 on the appliance wall 8. The male thread 13 fits through recesses 15 in the metal collar 5 of the plug or socket insert 6.

The accommodation of the screws 9 in the shielding housing is provided in this case to be such that laterally of the plug or socket insert 6, or in other words between it and the inside of the shielding housing 1, an adequately large intermediate space is provided, through which each of the screws 9 can pass.

A fixation of the plug or socket insert 6 in the plug-in direction is provided laterally by means of two diagonally opposed screws 16, which are screwed into the wall of the shielding housing radially between the bearing points 17 and the plug-side end 7 of the housing, and which enable a floating, self-finding bearing of the plug or socket insert relative to a counterpart plug 18 disposed on the appliance wall 8.

Figure 2:
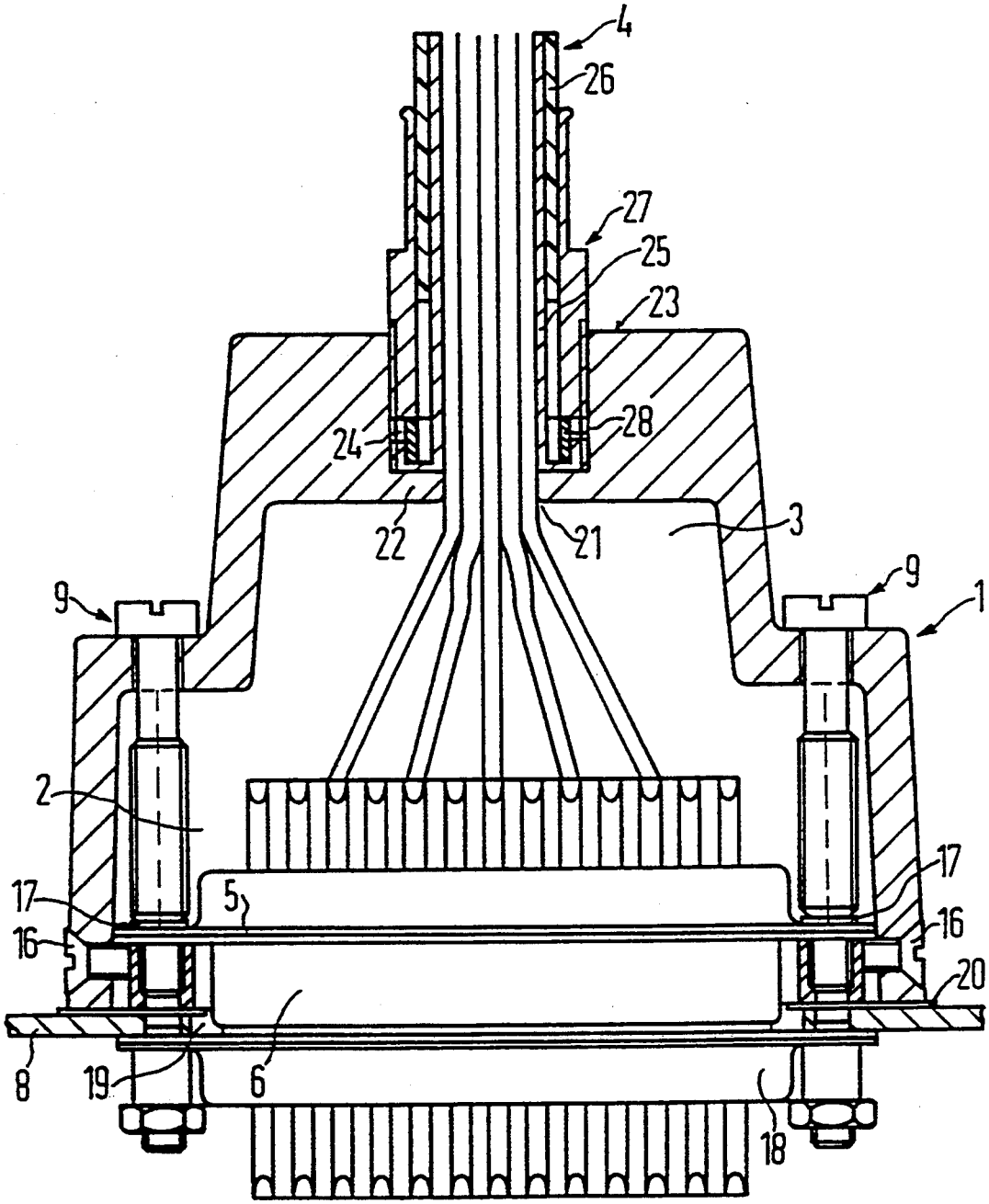
FIG. 2 is a fragmentary, sectional view similar to FIG. 1 of a plug connector secured to an appliance wall.

In the state of the plug connector shown in FIG. 2, in which it is secured to the appliance wall 8, the plug or socket insert 6 and the counterpart plug 18 are plugged to one another and electrically connected. The plug-side end 7 of the shielding housing 1 makes contact on the end surface with the appliance wall 8. An inside width of the shielding housing 1 on the plug end is selected in such a way that the plug or socket insert 6, its counterpart plug 18 on the appliance wall 8, and a lead-through opening 19 in the appliance wall are laterally surrounded by the plug-side edge of the housing. In this way, a complete encapsulation of the plug connector for electromagnetic fields is created.

In order to improve the contact between the shielding housing 1 and the appliance wall 8, particularly if the bearing support is not completely flat or if the appliance wall is vulnerable to or threatened by corrosion, an additional contact plate 20 may be disposed between the plug-side end 7 of the shielding wall 1 and the appliance wall 8. This plate 20 is provided with suitable cutouts, for instance for a lead-through of securing elements.

A connection of the cable 4 is carried out as follows: Once the plug or socket insert 6 is mounted in the shielding housing, as is shown in FIG. 1, the cable 4 is pushed back in a lead-through 21 in a transverse wall 22, which is provided crosswise relative to the plug-in direction in the connection region 3 of the shielding housing 1 and which is recessed inward opposite a connection-side end 23, far enough to ensure that a connection bore 24 is formed. Direct end-surface contact is produced between a cable shielding 25 and the transverse wall 22 of the shielding housing 1, with the aid of a union nut 27 of conductive material that is thrust over the cable sheath 26. To that end a sleeve 28, having an inside diameter which is approximately equal to the outside diameter of the cable 4, is thrust over a cable sheath 26 and over the exposed cable shielding 25. The cable shielding 25 is folded over through 180° onto this sleeve on one end thereof, and another end of the sleeve is engaged by the union nut 27. By tightening the union nut, the cable shielding 25, which is made of wire mesh, for instance, is then pressed on the end surface against the transverse wall 22 through the sleeve 28, and is thus contacted electrically.

Figure 3:
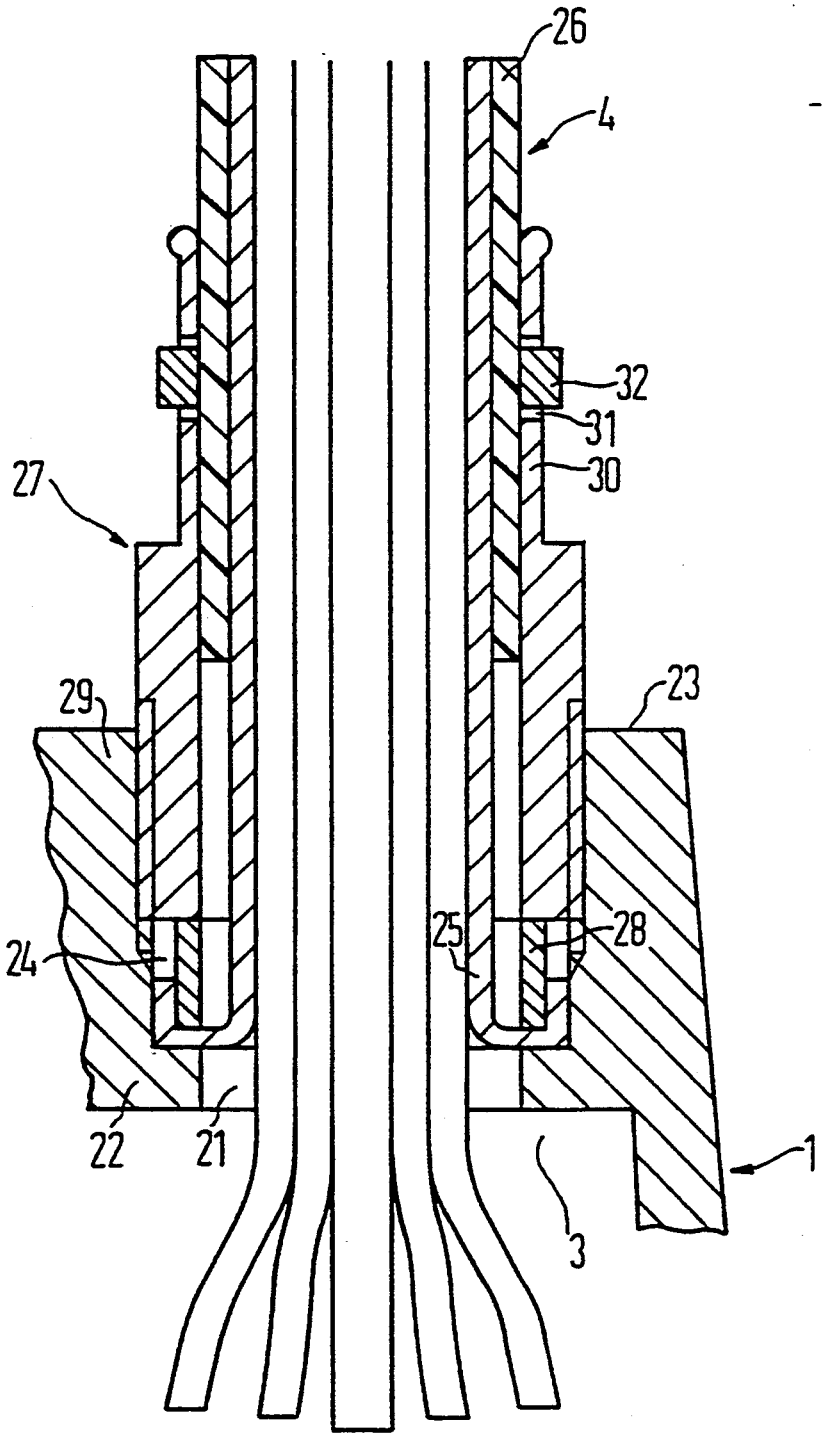
FIG. 3 is an enlarged, fragmentary, sectional view of a connection of a cable to the plug connector and contacting of a cable shielding in the shielding housing.

As is shown in FIG. 3, adjoining the threaded region 29, the union nut 27 is constructed with a neck 30 which rests on the cable sheath 26 and is provided with a window-like opening 31, into which a cable binder 32 is inserted and fixed to the cable sheath 26, in order to relieve tensile strain on the cable 4.

Figure 4:
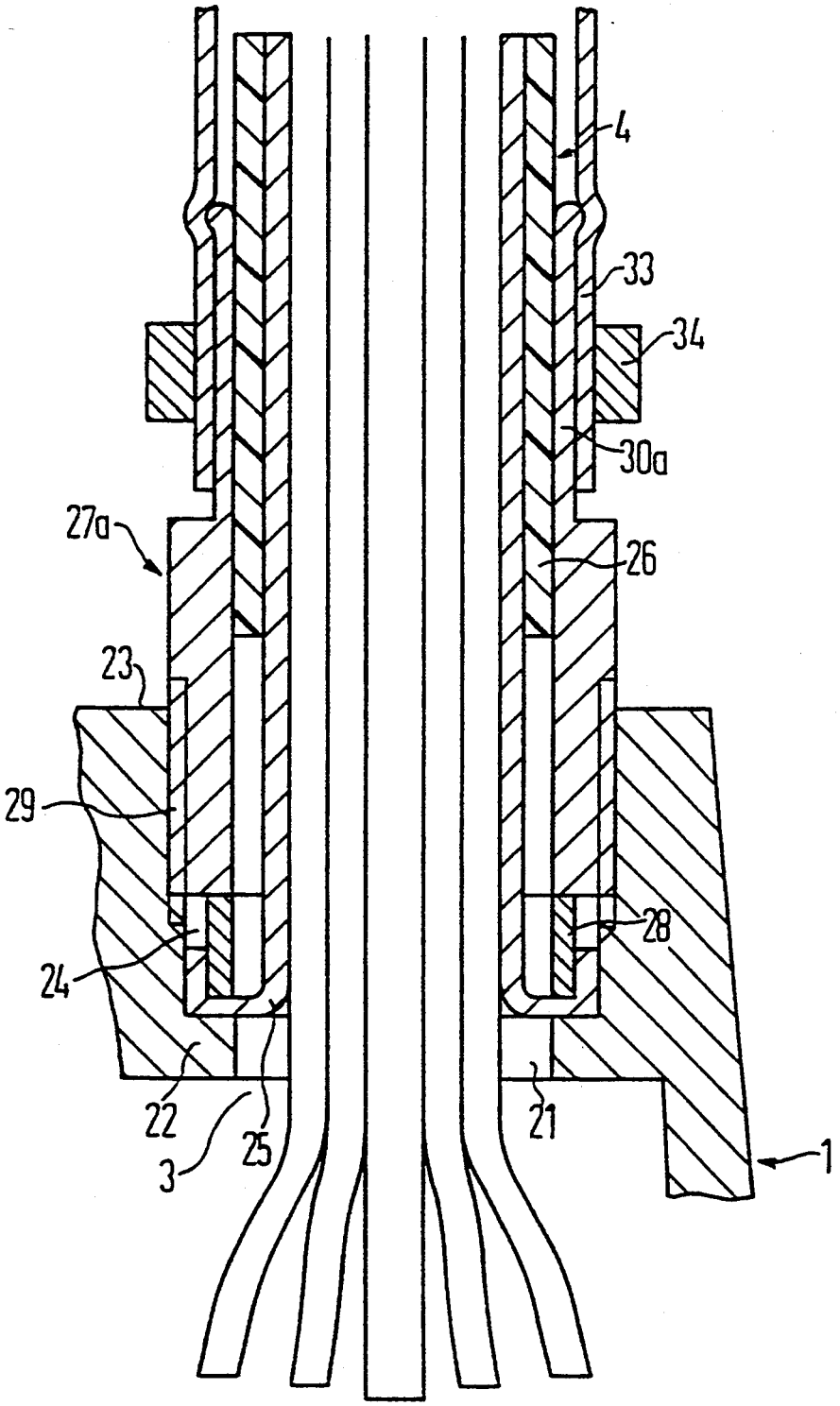
FIG. 4 is a view similar to FIG. 3 of another embodiment of the cable connection.

In a variant embodiment shown in FIG. 4, an additional tube 33 of a shielding braid is thrust over a neck **30*a* of a union nut 27*a* and is joined firmly to the neck 30*a* and contacted by means of a clamping ring 34. This variant can be employed to further improve the shielding action. The interior of the shielding housing 1** is constructed in such a way that even filtered plug connectors can be built in. Therefore, interference signals which might possibly be induced in the cable are also carried away to ground through the filter plug.

Figure 5:
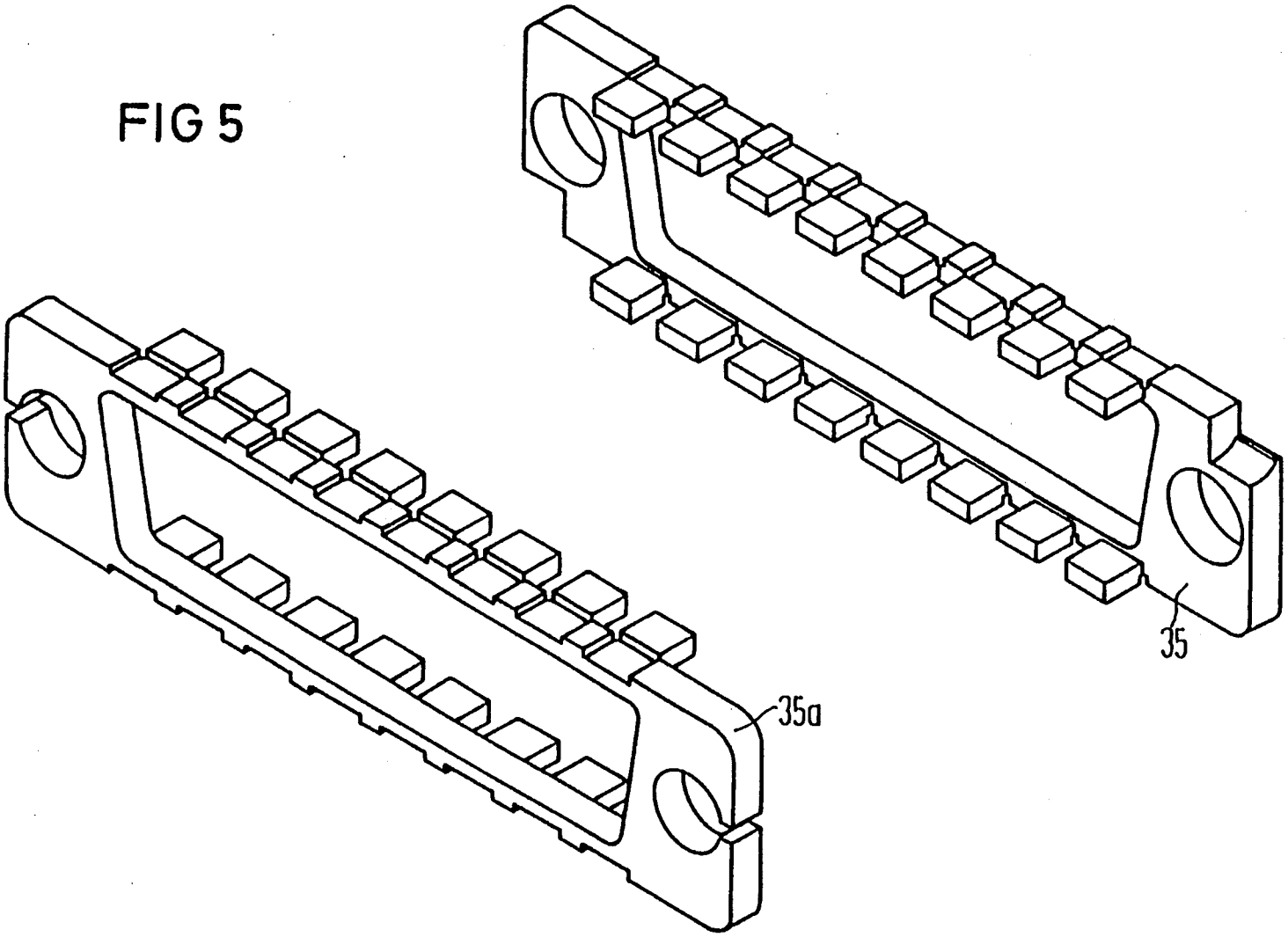
FIG. 5 is a perspective view of two encoding elements.

As a precaution against a combination of elements that can be plugged in wrong, encoding can also be integrated with the plug connector. To that end, each of the plug or socket insert 6 and the counterpart plug 18 are provided with a respective retrofittable encoding element 35 and **35*a* in the form of an encoding comb, as is shown in FIG. 5**. An encoding hole of an encoding element, which is created by a broken-off encoding tooth, then comes to rest opposite an encoding tooth of the counterpart element, in order to enable correct pairing.

We claim:

1. A shielded plug connector, comprising:

a) at least one shielded cable having a cable shielding;

b) a plug or socket insert having a metal collar; and c) a one-piece, one-shell, metal shielding housing, said shielding housing having a plug side at which said plug or socket insert is disposed, said plug side having an end surface and bearing points for said metal collar being recessed inwardly relative to said plug-side end surface, for end-surface contacting of said shielding housing with an appliance wall only at said plug-side end surface, and said shielding housing having a connection side with a connection region for connecting said at least one shielded cable, said connection region having a connection-side end and a transverse wall, said transverse wall being recessed inwardly relative to said connection-side end, having at least one lead-through formed therein and being in direct end contact with said cable shielding.

2. The plug connector according to claim 1, wherein said shielding housing is a pressure cast part.

3. The plug connector according to claim 1, wherein said pressure cast part is formed of aluminum.

4. The plug connector according to claim 1, wherein said bearing points for said metal collar of said plug or socket insert are recessed far enough inward to locate said plug or socket insert largely inside said shielding housing.

5. The plug connector according to claim 1, including securing elements for securing said shielding housing to the appliance wall, said shielding housing having an inner surface, and said plug or socket insert and said inner surface of said shielding housing defining an intermediate space therebetween for leading through said securing elements.

6. The plug connector according to claim 1, wherein the appliance wall has a counterpart plug disposed thereon and has a lead-through opening formed therein, and said plug end of said shielding housing has an internal width causing said plug or socket insert, said counterpart plug and said lead-through opening to be laterally surrounded by said plug-side end surface of said shielding housing, when the plug connector is secured to the appliance wall.

7. The plug connector according to claim 1, wherein said shielding housing has inner wall surfaces with two opposed steps disposed thereon forming said bearing points.

8. The plug connector according to claim 1, wherein said shielding housing has a wall, and including diametrically opposed screws being screwed into said wall of said shielding housing radially between said bearing point and said plug-side end of said shielding housing, for floating support of said plug or socket insert in said shielding housing.

9. The plug connector according to claim 1, including a contact plate disposed between said plug-side end of said shielding housing and the appliance wall.

10. The plug connector according to claim 1, including a union nut to be screwed into said connection region of said shielding housing, for connecting said cable.

11. The plug connector according to claim 10, wherein said cable shielding is exposed, and including a sleeve having two ends and being thrust over said exposed cable shielding, said cable shielding being folded over through 180° onto one end of said sleeve, and said union nut engaging the other of said ends of said sleeve, for electrically connecting said cable shielding to said union nut.

12. The plug connector according to claim 10, including a cable sheath on said cable shielding, said union nut having a neck resting on said cable sheath.

13. The plug connector according to claim 12, wherein said neck has a window-like opening formed therein, and including a cable binder being inserted into said window-like opening for tensile strain relief of said cable.

14. The plug connector according to claim 12, including an additional tube of a shielding braid being thrust over said neck of said union nut and being firmly joined to said neck, and a clamping ring contacting said additional tube.

15. The plug connector according to claim 1, wherein the appliance wall has a counterpart plug disposed thereon, and said plug or socket insert and the counterpart plug have an encoding element.

16. The plug connector according to claim 1, including two screws being displaceable in a plugging direction but disposed in captive fashion on said shielding housing, as securing elements for securing said shielding housing to the appliance wall.

* * * * *